US008425138B2

(12) United States Patent
deVirag et al.

(10) Patent No.: US 8,425,138 B2
(45) Date of Patent: Apr. 23, 2013

(54) SPREADABLE FOOD DISPENSER SYSTEM

(75) Inventors: Francis Kiss deVirag, Kirtland Hills, OH (US); Ileen Rosner, Novelty, OH (US); Jonathan Rosner, Novelty, OH (US); Alexander Sterling Wise, Mentor, OH (US)

(73) Assignee: Innovation Consumer Solutions, LLC, Novelty, OH (US)

( * ) Notice: Subject to any disclaimer, the term of this patent is extended or adjusted under 35 U.S.C. 154(b) by 1271 days.

(21) Appl. No.: 11/766,950

(22) Filed: Jun. 22, 2007

(65) Prior Publication Data

US 2008/0247805 A1 Oct. 9, 2008

Related U.S. Application Data

(60) Provisional application No. 60/823,855, filed on Aug. 29, 2006, provisional application No. 60/823,857, filed on Aug. 29, 2006, provisional application No. 60/823,860, filed on Aug. 29, 2006, provisional application No. 60/823,864, filed on Aug. 29, 2006, provisional application No. 60/823,866, filed on Aug. 29, 2006, provisional application No. 60/823,869, filed on Aug. 29, 2006.

(51) Int. Cl.
*B05C 11/00* (2006.01)

(52) U.S. Cl.
USPC ..... 401/266; 401/172; 401/175; 401/263; 401/265

(58) Field of Classification Search ..... 401/172, 401/174, 175, 265, 266, 263, 277
See application file for complete search history.

(56) References Cited

U.S. PATENT DOCUMENTS 5,890,630 A * 4/1999 Lobdell ..... 401/266
6,022,163 A * 2/2000 Asfur ..... 401/175
7,226,230 B2 * 6/2007 Liberatore ..... 401/266

* cited by examiner

*Primary Examiner* — Tuan N Nguyen
(74) *Attorney, Agent, or Firm* — Turocy & Watson, LLP

(57) ABSTRACT

A dispenser for spreadable foodstuffs and other spreadable substances allowing for spreading without the need for additional utensils not a part of the packaging is disclosed. The dispenser may rapidly switch between different disposable cartridges. Part of the dispenser is designed for an extended useful lifetime while the spreadable product is delivered in a disposable container. The dispenser can also be used to measure precise amounts of spreadable foodstuff and other spreadable products without the use of any additional measuring devices.

13 Claims, 8 Drawing Sheets

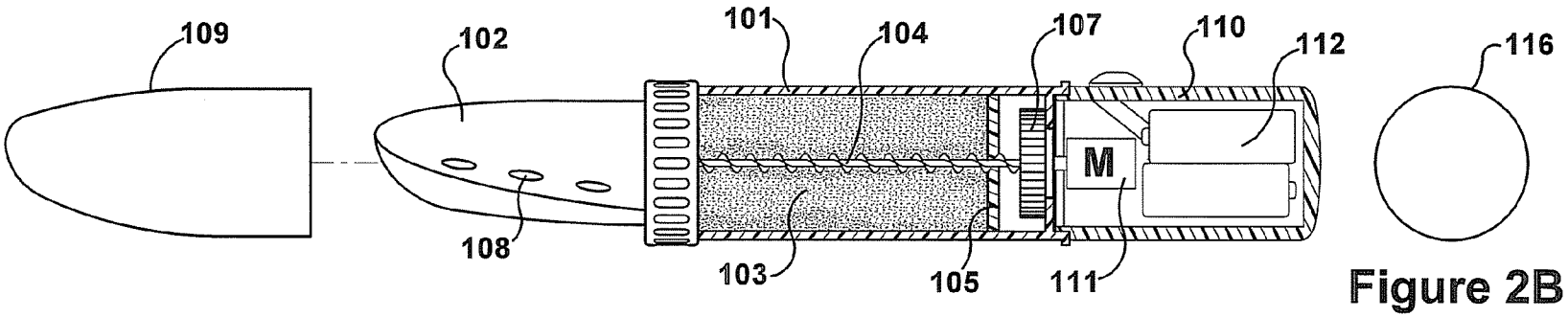
Figure 2B
Figure 2A
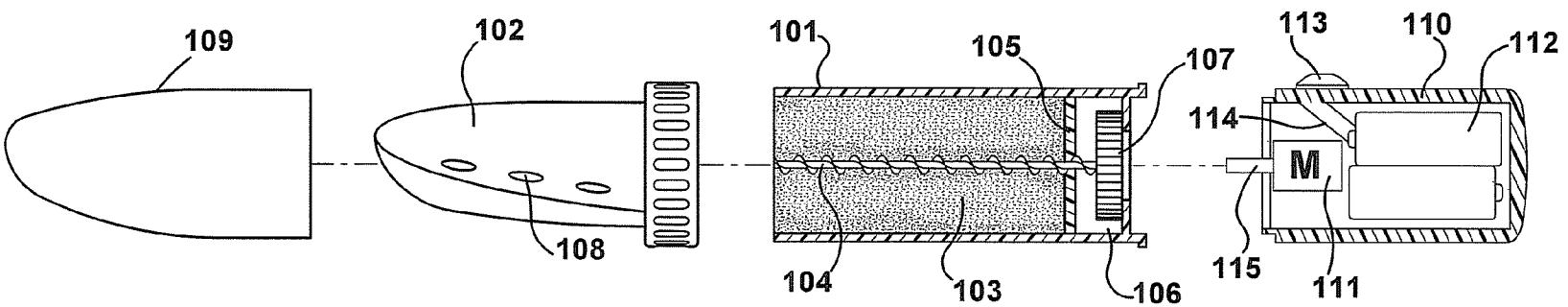
Figure 2C

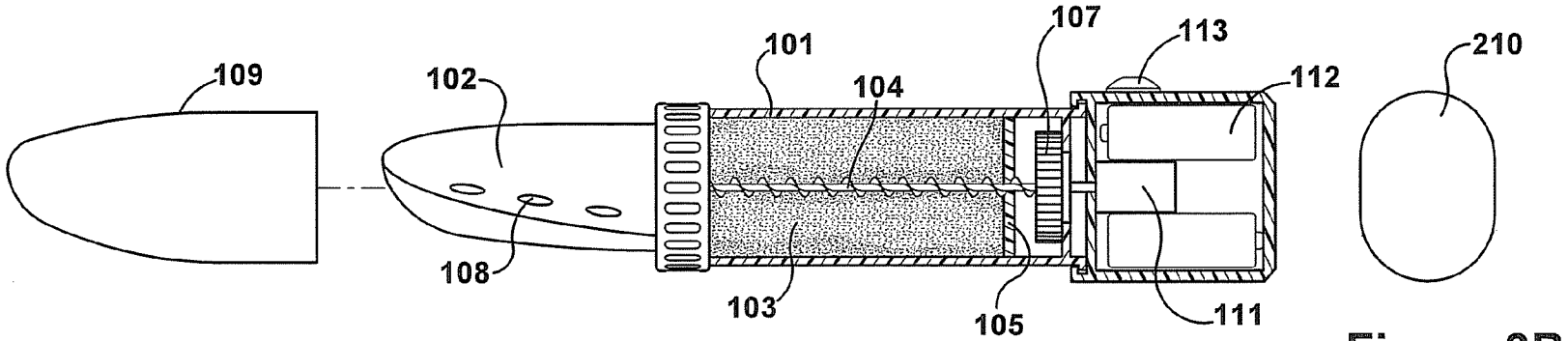
Figure 3A
Figure 3B
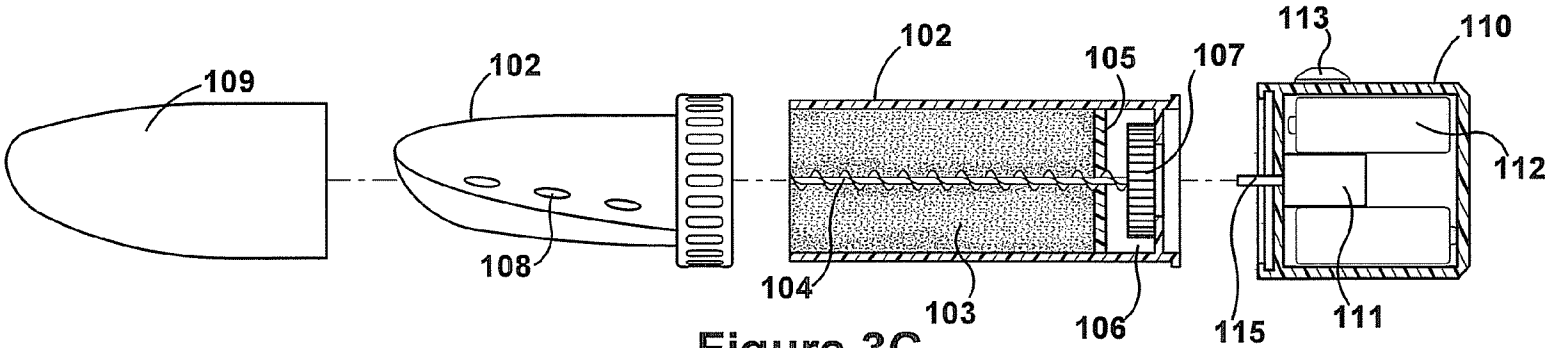
Figure 3C

SPREADABLE FOOD DISPENSER SYSTEM

CROSS REFERENCE TO RELATED APPLICATIONS

This application claims the benefit of priority from provisional application Ser. No. 60/823,855 filed Aug. 29, 2006, Ser. No. 60/823,857 filed Aug. 29, 2006, Ser. No. 60/823,860 filed Aug. 29, 2006, Ser. No. 60/823,864 filed Aug. 29, 2006, Ser. No. 60/823,866 filed Aug. 29, 2006, Ser. No. 60/823,869 filed Aug. 29, 2006, all of which are hereby incorporated by reference.

TECHNICAL FIELD

Described is a device for dispensing food products. In particular, the disclosure relates to dispensing spreadable foodstuffs evenly from a container without the need of a knife or other utensils not part of the food packaging.

BACKGROUND

The vast majority of packaging of spreadable foodstuffs lack any functionality to allow contents to be used directly from the packaging. The packaging for spreadable foodstuffs such as ketchup, mustard, cream cheese, peanut putter, jelly, etc. typically require a knife or other utensil not part of the food packaging to remove the foodstuff from a container and/or achieve spreading the foodstuff as desired. Even containers that allow for squeezing the foodstuff contained therein directly out of the packaging often still require a utensil not part of the food packaging to evenly spread the foodstuff. Such containers also often do not dispense foodstuffs easily as the void space of the container increases as foodstuff is consumed. Often the contents may splatter or take a significant amount of time to flow due to a large volume of air in the container. Air being introduced to the container during the products use also negatively affects product freshness. Traditional food containers also have limitations in conjunction with non-food products.

Traditional packaging is also typically challenging for children, elderly, disabled, or physically challenged individuals to use. Such containers also require utensils to be washed after every minor use of the product, which is a particular inconvenience during such activities as traveling, picnics, or other occasions where typical kitchen amenities are not present in addition to individuals who do not own a dishwasher.

Additionally, spreadable foodstuffs are often difficult if not impossible to measure via traditional means such as measuring cups. Very viscous foodstuffs such as peanut butter and cream cheese are difficult to measure with measuring cups since an accurate measurement may only be achieved by packing the product to remove any air left in the measuring cup. Even after an accurate measure is taken, it is extremely difficult to quantitatively transfer the measured product out from the measuring cup. A solution to accurate measurement and use of spreadable foodstuffs is particularly pertinent in restaurant settings where consistency is important. An accurate way to dispense spreadable foodstuffs is also important in home-settings for portion control and dieters.

The invention is also designed for use with a variety of non-food semi-solid or gelatinous substances. These substances include but are not limited to toothpaste, shoe polish, paints, cosmetics, thick oils, topical medications, and emollients. The typical containers for these substances are often the same and have the same limitations as those used for foodstuffs. These limitations include the need for additional utensils to remove and use the substance from the container, air being introduced to the containers over time as the substance is used, difficulty of use for children or individuals with physical limitations, and difficulty in measuring with measuring cups or other measuring means. Typical packaging for glue, polishes, paints, ect. requires the consumer to haphazardly obtain the desired amount of product by use of a cloth or brush separate from the product packaging. A more versatile packaging with the functionality to accurately measure and dispense food as well as non-food item without the use of additional utensils is lacking in the market place.

SUMMARY

The following presents a simplified summary of the invention in order to provide a basic understanding of some aspects of the invention. This summary is not an extensive overview of the invention. It is intended to neither identify key or critical elements of the invention nor delineate the scope of the invention. Rather, the sole purpose of this summary is to present some concepts of the invention in a simplified form as a prelude to the more detailed description that is presented hereinafter.

The subject invention provides for spreadable foodstuffs to be packaged in a container that has a means for spreading the contained foodstuff in a knife-like manner without the use of any additional utensils not part of the food packaging as well as providing for a packaging of adjustable volume such that product is kept away from air during use.

One aspect relates to providing a convenient means of use of spreadable foodstuffs and non-food products in residences without the need for utensils not part of the packaging. An additional aspect relates to providing a convenient and easy to use means for spreading foodstuffs and non-food products for elderly, disabled, children, and physically challenged persons. Another aspect relates to providing a convenient means of use of spreadable foodstuffs and non-food products for those traveling, picnics or other outdoor activities, or other times when traditional kitchen amenities are not available.

Yet another aspect of the disclosure herein relates to providing a means for restaurants and caterers to dispense and use spreadable foodstuffs with greater speed. Still yet another aspect of the disclosure herein relates to providing a packaging for spreadable foodstuffs and non-food products that keeps contents fresher once seal on package has been broken.

Another aspect of the disclosure herein relates to minimizing product waste compared to traditional packaging.

An additional aspect of the disclosure herein is to provide a packaging that is less disposable than traditional packaging and therefore suitable for targeted and affinity marketing in a more affective manner. Still yet another aspect of the disclosure herein is to provide for an automated means of dispensing spreadable foodstuffs and non-food products that may easily and rapidly switch between dispensing different products. An additional aspect of the disclosure herein is to provide an automated means of dispensing spreadable products that is ergonomical.

To the accomplishment of the foregoing and related ends, the invention comprises the features hereinafter fully described and particularly pointed out in the claims. The following description and the annexed drawings set forth in detail certain illustrative aspects and implementations of the invention. These are indicative, however, of but a few of the various ways in which the principles of the invention may be employed. Other objects, advantages and novel features of the invention will become apparent from the following detailed description of the invention when considered in conjunction with the drawings.

BRIEF SUMMARY OF THE DRAWINGS

FIG. 2 is a view of the second embodiment comprising a disposable cartridge, knife-like applicator, and a motorized handle.

FIG. 3 is an alternate arrangement of the second embodiment.

DETAILED DESCRIPTION

Figure 1:
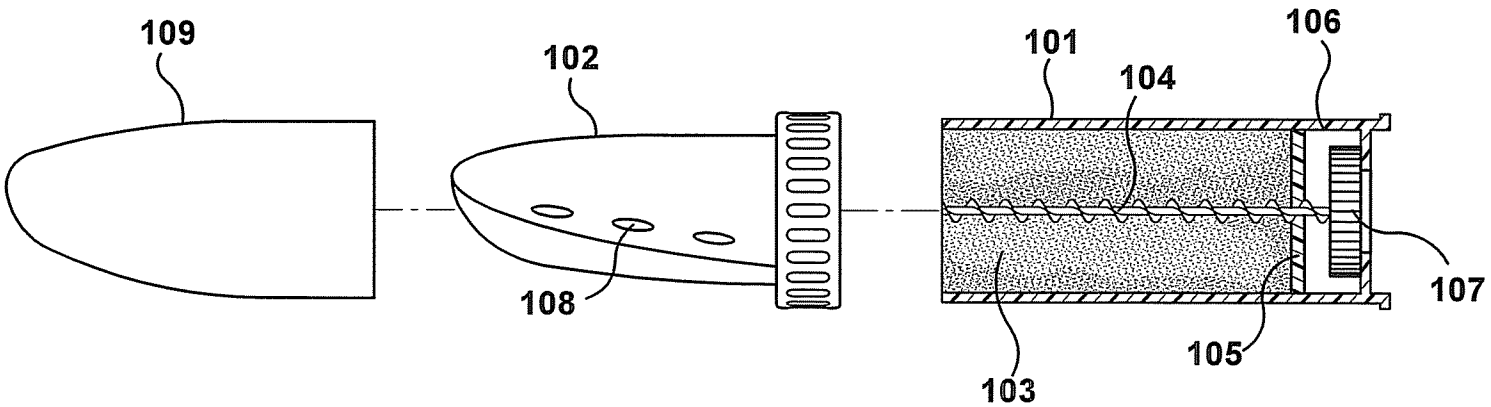
FIG. 1 is a view of the first embodiment comprising a disposable cartridge and knife-like applicator.

The dispensing system described herein facilitates the use and application of spreadable foodstuffs. Rather than using a knife or spoon to transfer a foodstuffs from a jar or other container to an object, such as a plate or food item such as a slice of bread; the dispensing system described herein allows for the direct transfer of foodstuffs from the container in which they are stored to a desired location without use of an intermediate transfer and/or without using a transfer utensil such as knife or spoon. The dispensing system provides not just the advantage of a time-savings benefit, but also an environmental advantage in that it not necessary to use and subsequently clean food utensils.

The food packaging can be of a substantially cylindrically shape which is ergonomically designed to fit comfortably in the human hand. The cross-section can be circular, oval, polygonal, and the like. The shape of the dispenser itself may be shaped to have an affinity or novelty quality (i.e., a baseball bat). The unit is composed of a Replacement Cartridge Product (RPC) portion and a driver handle portion. The driver handle has an extended useful lifetime and can be used to dispense several different kinds of spreadable products.

The spreadable product is supplied in the RCP. The RCP is a substantially cylindrical tube composed of rigid or semi-rigid food-grade plastic. The RCP can be made for single or multiple uses. One end of the RCP has a coupling mechanism allowing the RCP to reversibly attach to the driver handle. The other end of the RCP has an applicator portion that has a knife-like shape and may be either permanently molded to the RCP or detachable through threading or other mechanism. The knife-like applicator has a knife-like, pyramidal, or triangular shape. One edge of the applicator has a series of holes or openings through which spreadable products pass upon dispensing. In this manner, spreadable products may be dispensed directly on an object to the location of desired use and immediately spread without the use of any other utensils besides the entire dispensing system.

The mechanical operation of the dispensing system is as follows. The RCP contains a screw-spindle running along the longitudinal axis of the RCP. The RCP attaches to the driver handle via threading or other common mechanism. The end of the RCP that attaches to the driver handle is comprised of a plunger member that is attached to said screw spindle. The plunger member forms a tight seal with the body of the RCP but still capable of sliding along the body of the RCP. When the RCP is attached to the driver handle, the screw spindle fits into a receptacle on the coupling end of the driver handle. A mechanism inside the driver handle turns the screw-spindle which in turn moves the plunger member along the body of the RCP. Movement of the plunger member expels spreadable product through the opening on the applicator. The mechanism inside the driver handle may either be powered manually by the user or by an electric motor. The RCP is designed to be disposable upon use of most or all of the spreadable product contained inside.

One embodiment of the dispensing system is depicted in FIG. 1. The embodiment is composed of an RCP 101 and a knife-like applicator 102. The body of the RCP 101 is composed of rigid or semi-rigid food grade material. The RCP comprises mostly a hollow space 103, which contains the spreadable product. There is a screw-spindle 104 running along the longitudinal axis of the RCP. There is a plunger member 105 located at one end of the RCP and a lip 106 surrounding that end of the RCP. A wheel 107 is situated inside the lip and attached to the screw-spindle 104. Upon turning the wheel 107, the plunger member 105 travels along the screw-spindle 104 resulting in spreadable product leaving the system and a proportional reduction in the volume of the space 103. The wheel 107 may be manually operated when not attached to the driver handle 101. Part of the lip 106 is cut away to allow the circular wheel 107 to be accessible from the side of the RCP. If required, the foodstuff can be manually squeezed out of the RCP when the RCP is constructed out of semi-rigid material. The RCP can be designed to attach to the driver handle through threading, a latch and spring mechanism, or a twist and lock mechanism, all of which are common in the art.

A knife-like applicator 102 is attached to the RCP as shown in FIG. 1. The applicator 102 contains several openings 108 that allow foodstuffs or other spreadable products to pass through. The applicator 102 attaches to the RCP 101 through a threaded connector or snap and lock mechanism, which are common in the art. The applicator 102 may be made from metal, such as stainless steel, or food grade plastic. The RCP 101 combined with the applicator 102 form a complete embodiment of the invention. Turning of the wheel 107 by a user causes spreadable product to emerge from the openings 108 on the applicator 102. Depending on the viscosity of the spreadable product, the invention may be used either by loading the applicator 102 with spreadable product followed by application to a desired location or by dispensing spreadable product directly to the desired location. When the dispenser is not in use, a cap 109 may be used to cover the opening 108 on the applicator 102 in order to keep the spreadable product fresh.

An additional embodiment (shown in FIG. 2) may be constructed by attaching a driver handle 110 to the RCP 101 and applicator 102. The driver handle 110 consists of an electric motor 111 along with a space to store batteries 112. The electric motor 111 is activated by a button 113 located on the surface of the dispenser and connected to the motor 111 through a wire 114. The electric motor 111 turns a stem 115, which in turn rotates the screw-spindle 104 when the driver handle and RCP are attached. The arrangement of the electric motor 111 and batteries 112 may be modified to change the length and shape of the dispenser. FIG. 3 shows and alternate arrangement of the electric motor 111 and batteries 112. Note that the arrangement of electric motor 111 and the batteries 112 can change the footprint of the dispenser 116 or 201. The shape of the footprint can be used to change the amount that the circular wheel 107 protrudes from the side of the unit and therefore affect the ease of manually turning the wheel 107 when the RCP 101 is attached to the driver handle 110.

Figure 4B:
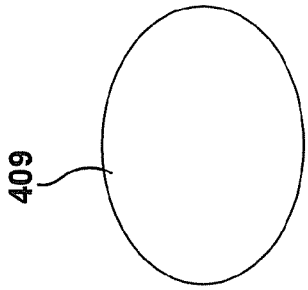
FIG. 4 is a view of the third embodiment comprising a disposable cartridge that is recessed into a space in the motorized handle.
Figure 4A:
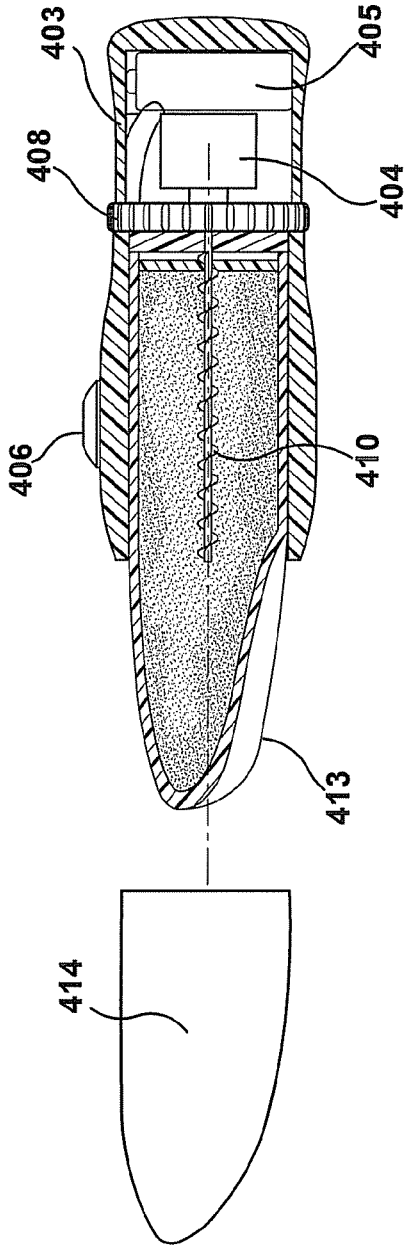
Figure 4C:
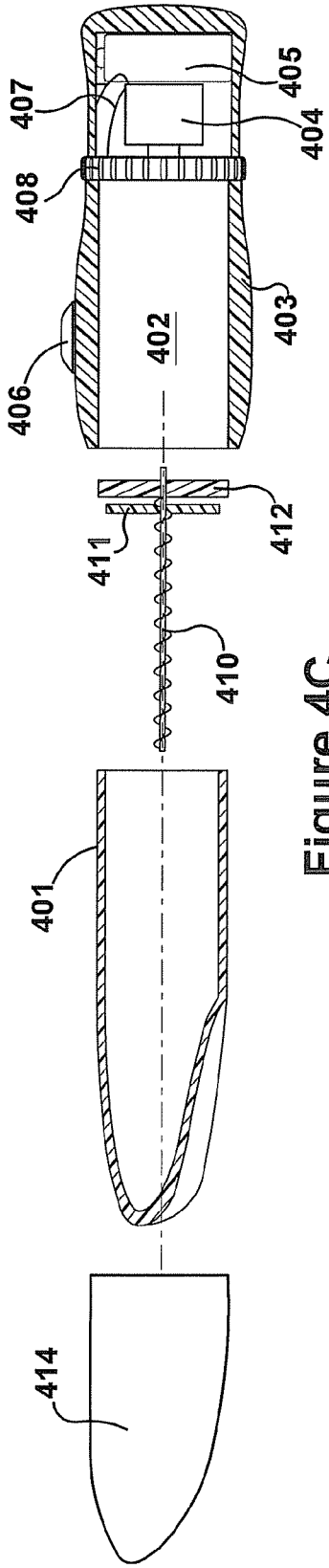

A third embodiment of the invention is shown in FIG. 4. In this embodiment, a majority of the RCP 401 is recessed in a space 402 formed by the driver handle 403. This configuration allows the dispensing system to be more compact than in the first embodiment. The driver handle 403 is comprised of an electric motor 404 and batteries 405 as in the previous embodiment. The electric motor 404 is activated via a button 406 on the housing of the dispenser and connected to the electric motor 404 via a wire 407. In this embodiment the wheel 408, which allows for manual operation, is an integral part of the dispenser. Preferably, the footprint of the driver handle 409 is in an elliptical shape to allow a portion of the circular wheel 408 to protrude outside the casing of the driver handle. This allows for the wheel 408 to be operated manually with ease. Note that the orientation of the batteries 405 is important for achieving an elliptical footprint 408. The screw-spindle 410 and plunger member 411 may be made a part of either the RCP, the driver handle, or be a separate detachable part. The embodiment as shown in FIG. 3 is comprised of a screw-spindle 410 and plunger member 411 that are freely detachable from the driver handle and RCP. The wheel 408 has a receptacle in the middle to couple with the screw spindle 411. An optional base member 412 may be used to ensure proper orientation of the screw-spindle 410. This embodiment allows the RCP 401 to be constructed without any movable internal parts allowing for the disposable RCP to be more inexpensively constructed. As shown in FIG. 3, the knife-like applicator 413 may be constructed in one piece with the RCP. Optionally, the knife-like applicator may be detachable (not shown). A lid 414 is used to cover the openings on the applicator in order to keep the spreadable product fresh when not in use.

Figure 5:
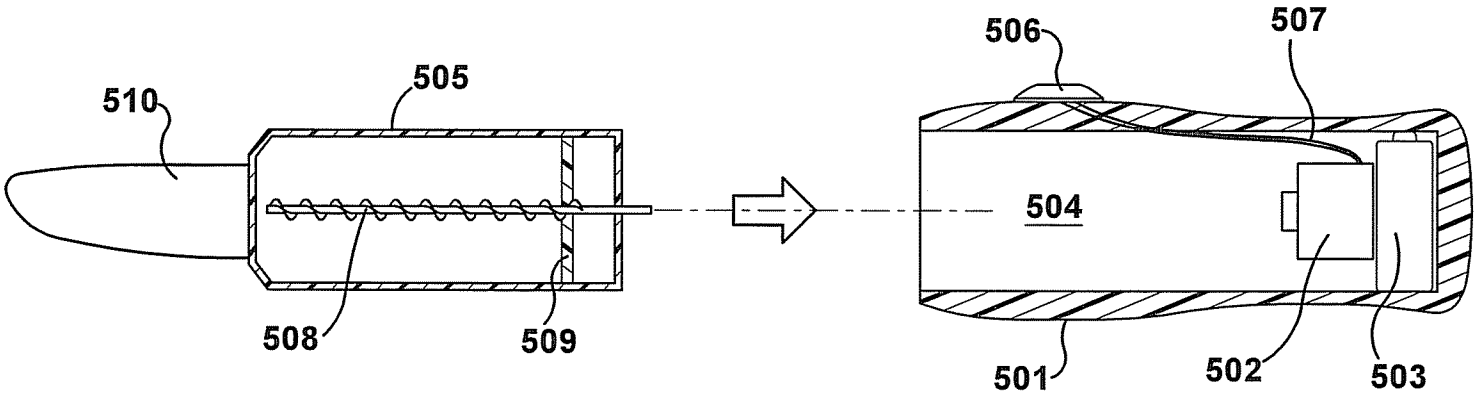
FIG. 5 is a view of the fourth embodiment of the invention comprising a disposable cartridge that is recessed into a space in the motorized handle.
Figure 6E:
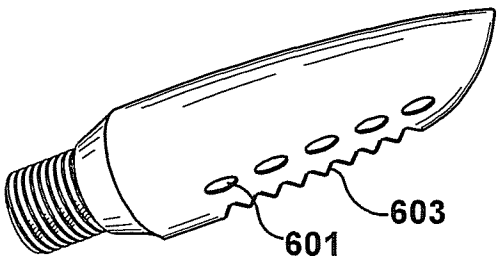
FIG. 6 are views of alternative examples of knife-like applicators having openings therein.
Figure 6B:
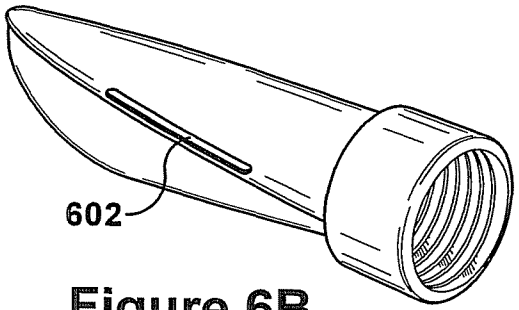
Figure 6D:
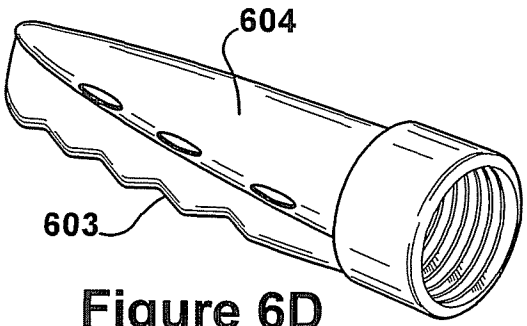
Figure 6A:
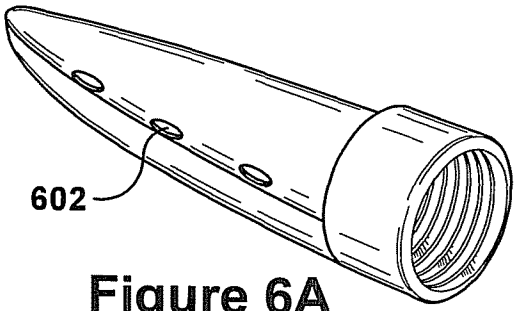
Figure 6C:
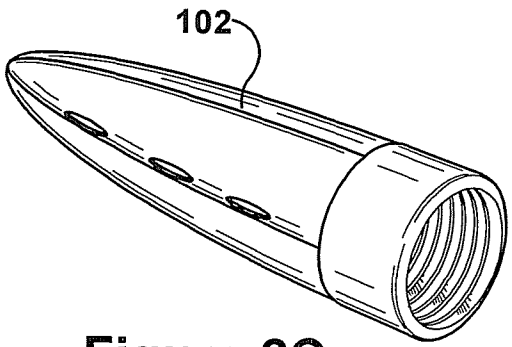
Figure 7A:
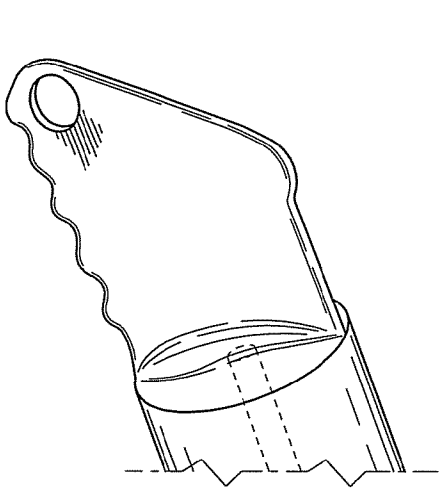
FIG. 7 are views of alternative examples of knife-like applicators having openings therein.
Figure 7B:
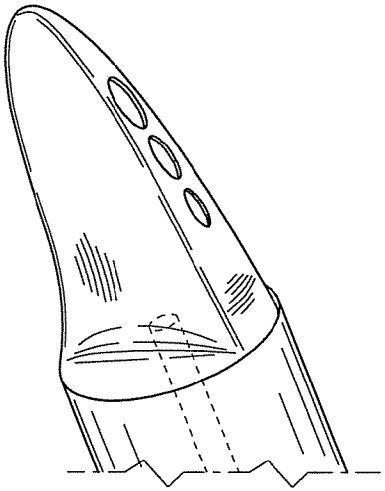
Figure 7C:
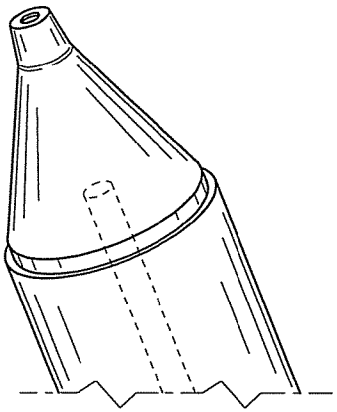
Figure 7D:
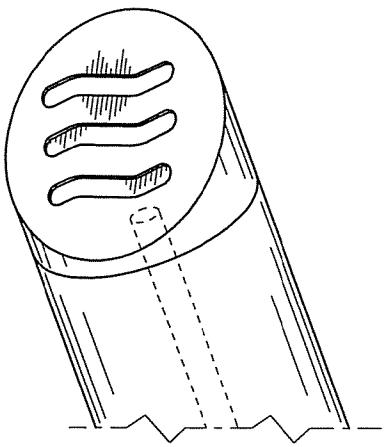
Figure 7E:
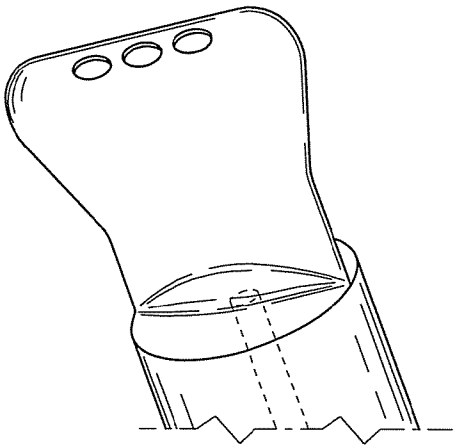
Figure 7F:
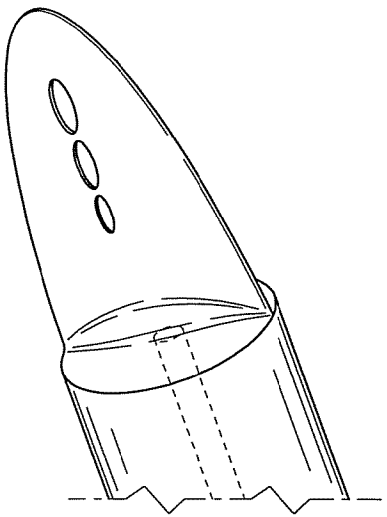

A fourth embodiment of the invention shown in FIG. 5 comprises a driver handle 501 comprising a electric motor 502, batteries 503, and a space 504 to accommodate the RCP 505 recessed into the driver handle. The electric motor 502 is operated via a button 506 located on the housing of the driver handle and connected to the electric motor 502 via a wire 507. The RCP 505 is comprised of a screw-spindle 508 and a plunger member 509 as in the first embodiment. Alternatively, the screw-spindle may be incorporated as part of the driver handle or be a separable component (not shown). The applicator 510 may be designed to be molded to the RCP 505 or be detachable. A lid 511 covers the openings in the applicator 510 when not in use.

FIG. 6 shows several examples of knife-like applicators that may be used in any of the foregoing embodiments. The dispensing end of the RCP 101 is designed to attach to the knife-like applicator 102 through threading, a latch and spring mechanism, or a twist and lock mechanism, all of which are extremely common in the art. Optionally, the RCP 101 and applicator 102 may be molded in one piece (as in the embodiment in FIG. 4). The number and diameter of the openings is selected based on the consistency or viscosity of the product. For example, a large number of smaller holes 601 are useful for less viscose products such as jelly or ketchup. One or two large holes 602 are appropriate for very viscose products such as peanut butter or cream cheese. The applicator may be shaped into an unlimited number of shapes that are deemed to have utility in dispensing the desired product. An edge of the applicator may be designed to have cutting ability 603. The flat surface of the applicator 604 is used in a knife-like fashion to spread the food stuffs as desired. Also, depending of the viscosity of the foodstuffs, the foodstuffs may be dispensed completely onto a surface and then spread. For some high viscosity foodstuffs, dispensing of such foodstuff may preload the flat surface of the applicator 604 with food product that may then be spread onto a desired location.

Figure 8:
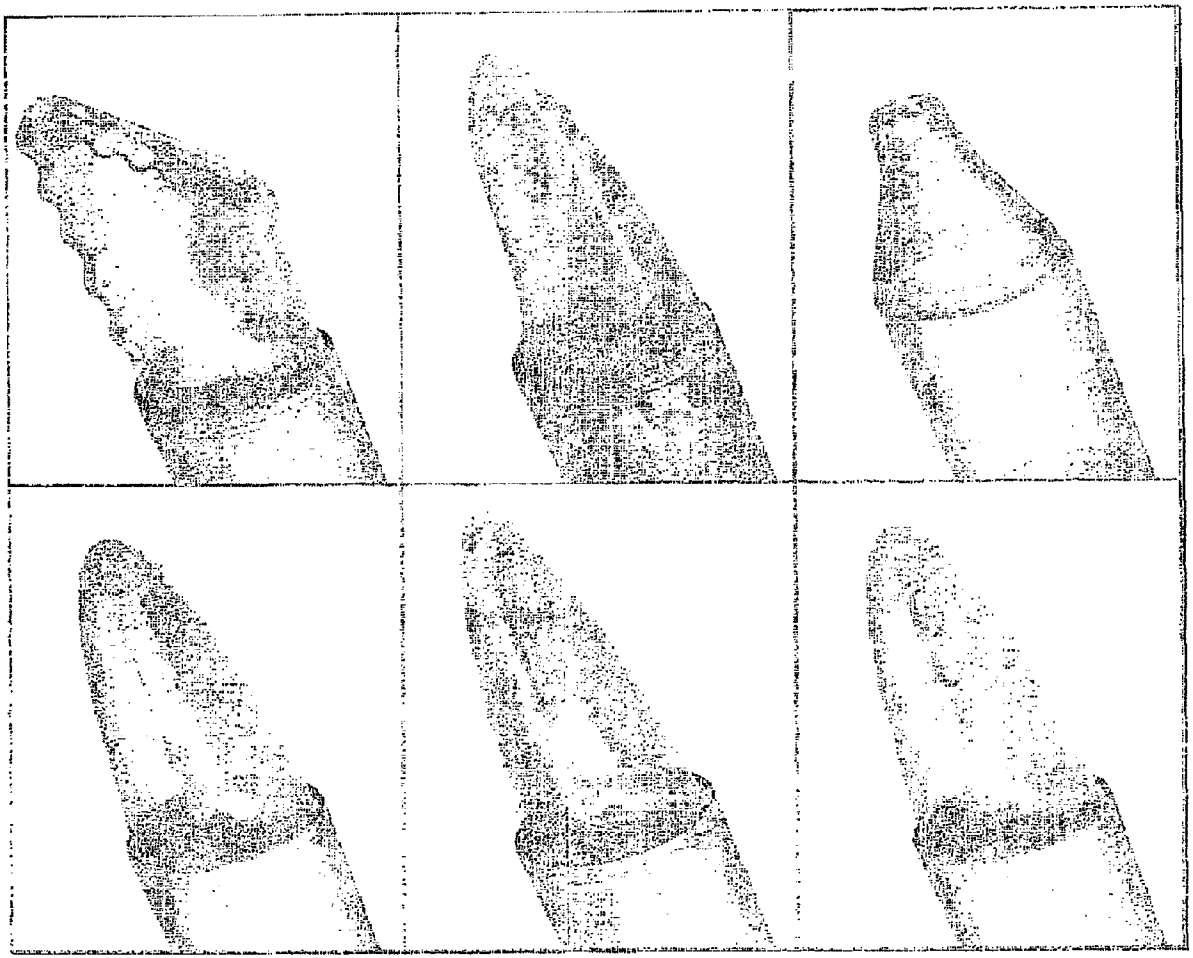
FIG. 8 are views of alternative examples of knife-like applicators having openings therein.

FIG. 7 and FIG. 8 each depict six additional examples of knife-like applicators that may be used in any of the foregoing embodiments. The precise architecture of the knife-like applicator is selected based upon one or more of a number factors including the viscosity of the foodstuffs, the type of substrate on which the foodstuffs are spread, the desired appearance of the foodstuffs on the substrate, the desired amount of foodstuffs on the substrate, the desired rate at which foodstuffs are applied to the substrate, and the like.

Any of the preceding embodiments may be further modified to comprise a component or means of metering the dispensing of spreadable product in either units of volume or weight. In one modification, the RCP is comprises transparent or semitransparent material such that the plunger member is visible through the body of the RCP. The body the RCP is further marked with graduations in units of weight or volume based on the volume of the RCP and/or density of spreadable product contained therein. A user may ascertain the amount of spreadable product dispensed by observing the movement of the plunger member relative to the graduation marks. In a second modification, graduation marks are placed on the circular wheel and the amount of product dispensed is ascertained by the user counting graduation marks passing a fixed point while the wheel is rotating during dispensing. In embodiments where the wheel is a fixed part of the driver handle, multiple sets of graduation marks may be placed on the wheel to correspond to different sizes of RCPs that may be dispensed with that driver handle. In a third modification, a CPU and Rom are coupled the electric motor inside the driver handle. The CPU may be programmed through a simple LCD located on the body of the driver handle.

Any spreadable foodstuff with suitable viscosity can be employed in the dispensing system. Examples of foodstuffs that can be applied/spread using the dispensing system described herein include butter, margarine, jelly, ketchup, mustard, mayonnaise, frosting, peanut butter, cream cheese, custard, sauces including barbeque sauce, syrups, thick oils, dips, and the like.

While the invention has been explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A dispensing system for spreadable foodstuffs allowing for spreading without utensils separate from the dispensing system comprising:

a single use disposable container having a longitudinal central axis having an opening for the spreadable foodstuffs, the spreadable foodstuff being supplied in the disposable container and the disposable container have a temporary seal;

a screw-spindle arranged along the longitudinal axis of the disposable container;

a knife-like applicator attached to the single use disposable container comprising at least one opening that allows spreadable foodstuffs to pass through; and a handle that attaches to the single use disposable container, the handle comprising a component for rotating the screw-spindle, wherein the component for rotating the screw-spindle comprises an electric motor and a microprocessor that determines the amount of foodstuffs to be dispensed and at what rate to dispense it.

2. The dispensing system according to claim 1 wherein the single use disposable container further comprises a plunger member attached to the screw spindle.

3. The dispensing system according to claim 1 wherein the single use disposable container further comprises graduation marks on the surface of the single use disposable container.

4. The dispensing system according to claim 1, the knife-like applicator comprising at least two openings.

5. The dispensing system according to claim 1 wherein the knife-like applicator is detachable.

6. A method of spreading foodstuffs without utensils separate from a foodstuffs dispenser, comprising:

depositing the foodstuffs on an object through a knife-like applicator connected to a single use disposable container supplying the foodstuffs of the foodstuffs dispenser, the knife-like applicator comprising at least one opening that allows foodstuffs from the single use disposable container to pass therethrough, wherein depositing is cause by a handle that attaches to the single use disposable container, wherein a rotating screw-spindle causes foodstuff to pass through the knife like applicator, wherein the foodstuffs pass through the knife-like applicator by action of an electric motor, wherein a microprocessor, coupled with the electric motor, determines the amount of the foodstuffs to be dispensed and at what rate to dispense it;

spreading the foodstuffs on the object using the knife-like applicator; and replacing the single use disposable container with a second disposable container.

7. The method according to claim 6, wherein the foodstuffs pass through the knife-like applicator by action of a plunger member in the disposable container.

8. The method according to claim 6, wherein the foodstuffs pass through at least two openings in the knife-like applicator.

9. The method according to claim 6, wherein the foodstuffs pass through the knife-like applicator by action of the rotating screw-spindle powered by an electric motor.

10. The method according to claim 6, wherein the foodstuff is spread onto the surface with the flat surface of the knife-like applicator and wherein no additional utensils are needed to spread the foodstuffs.

11. The method according to claim 6, wherein the foodstuffs comprise at least one of jelly, peanut butter, butter, ketchup, mustard, or mayonnaise.

12. The method according to claim 6, wherein the foodstuffs comprise a plurality of foodstuff types.

13. The dispensing system according to claim 1 wherein the wherein, the screw-spindle is separate from the dispensable container.

* * * * *